United States Patent [19]

Ralston, Jr.

[11] 4,251,336

[45] Feb. 17, 1981

[54] METHOD FOR DETECTING INCIPIENT SHORT CIRCUITS IN ELECTROLYTIC CELLS

[75] Inventor: Richard W. Ralston, Jr., Cleveland, Tenn.

[73] Assignee: Olin Corporation, New Haven, Conn.

[21] Appl. No.: 87,200

[22] Filed: Oct. 22, 1979

Related U.S. Application Data

[63] Continuation-in-part of Ser. No. 14,176, Feb. 22, 1979, Pat. No. 4,174,267, which is a continuation-in-part of Ser. No. 919,530, Jun. 27, 1978, Pat. No. 4,155,829, which is a continuation-in-part of Ser. No. 605,582, Aug. 18, 1975, Pat. No. 4,098,666, which is a continuation-in-part of Ser. No. 489,647, Jul. 18, 1974, Pat. No. 3,900,373, which is a continuation-in-part of Ser. No. 272,240, Jul. 17, 1972, abandoned.

[51] Int. Cl.[3] ..... C25B 1/36; C25B 15/06

[52] U.S. Cl. ..... 204/99; 204/219; 204/225

[58] Field of Search ..... 204/99, 219–220, 204/225, 250

[56] References Cited

U.S. PATENT DOCUMENTS

| | | | |
|---|---|---|---|
| 3,844,913 | 10/1974 | Warren | 204/219 X |
| 3,853,723 | 12/1974 | Mack | 204/219 X |
| 3,926,750 | 12/1975 | Adachi et al. | 204/99 |
| 4,035,268 | 7/1977 | Hote | 204/99 |
| 4,069,118 | 1/1978 | Hixson et al. | 204/225 X |
| 4,082,639 | 4/1978 | Ralston, Jr. et al. | 204/225 X |

FOREIGN PATENT DOCUMENTS

| | | | |
|---|---|---|---|
| 2000928 | 7/1971 | Fed. Rep. of Germany | 204/99 |
| 2461473 | 7/1976 | Fed. Rep. of Germany | 204/99 |
| 49-35519 | 9/1974 | Japan | 204/225 |

*Primary Examiner*—T. Tung
*Assistant Examiner*—D. R. Valentine
*Attorney, Agent, or Firm*—Donald F. Clements; James B. Haglind

[57] ABSTRACT

An improved method and apparatus for adjusting the space between an adjustable anode and a cathode in an electrolytic cell wherein current measurements and voltage measurements are obtained for conductors to the anode sets and compared with predetermined standards for the same conductors and anode sets. Measurement of deviation from the predetermined standards are used to determine the direction of anode adjustment. A digital computer operably connected to motor drive means adapted to raise or lower anode sets upon appropriate electric signals from the computer is a preferred embodiment of this invention.

7 Claims, 6 Drawing Figures

METHOD FOR DETECTING INCIPIENT SHORT CIRCUITS IN ELECTROLYTIC CELLS

This application is a continuation-in-part of Ser. No. 014,176 filed Feb. 22, 1979, now U.S. Pat. No. 4,174,267 which issued Nov. 13, 1979, which was a continuation-in-part of co-pending application Ser. No. 919,530 filed June 27, 1978, now U.S. Pat. No. 4,155,829 which issued May 22, 1979, which was a continuation-in-part of co-pending application Ser. No. 605,582 filed Aug. 18, 1975, now U.S. Pat. No. 4,098,666 which issued July 4, 1978, which was a continuation-in-part of co-pending application Ser. No. 489,647 filed July 18, 1974, now U.S. Pat. No. 3,900,373, which issued Aug. 19, 1975, which was a continuation-in-part of abandoned application Ser. No. 272,240 filed July 17, 1972.

The present invention relates to a method and apparatus for adjusting the anode-cathode spacing in an electrolytic cell. In particular, the invention relates to an improved method and apparatus for adjusting the anode-cathode spacing in electrolytic mercury cells for the electrolysis of alkali metal chlorides such as sodium chloride. More particularly, this invention relates to a technique for detecting and avoiding incipient short circuits in electrolytic mercury cells.

In electrolytic cells with adjustable anodes, the control of the inter-electrode distance between the anode and the cathode is economically important. The anode-cathode spacing should be narrow to maintain the voltage close to the decomposition voltage of the electrolyte. Careful control of the anode-cathode spacing reduces energy lost in the production of heat and reduces short circuiting and its accompanying problems which include the destruction of anode surfaces and the contamination of electrolytic products.

Numerous techniques have been developed to adjust the anode-cathode gap in electrolytic cells. For example, U.S. Pat. No. 3,574,073, issued Apr. 6, 1971, to Richard W. Ralston, Jr., discloses adjustment means for anode sets in electrolytic cells. In this patent, a means responsive to changes in the flux of the magnetic field generated by electrical flow in a conductor supplying the anode sets controls the opening and closing of an electrical circuit, and activates hydraulic motors which are effective to raise or lower the anode sets. In addition, a cell voltage signal and a temperature compensated amperage signal proportional to the bus bar current for the anode set are fed as input to an analog computer which produces an output reading of resistance calculated according to the formula:

$$R=(E-E_r)/I$$

where R is the resistance of one anode set, E is the cell voltage, $E_r$ is the reversible potential of the particular electrode-electrolyte system and I is the current flowing to the anode set. Each anode set has a characteristic resistance at optimum efficiency to which that anode set is appropriately adjusted.

U.S. Pat. No. 3,558,454, which issued Jan. 26, 1971, to Rolph Schafer et al, discloses the regulation of voltage in an electrolytic cell by measuring the cell voltage and comparing it with a reference voltage. The gap between electrodes is changed in accordance with deviations between the measured voltage and the reference voltage and all electrodes in the cell are adjusted as a unit.

Similarly, U.S. Pat. No. 3,627,666, which issued Dec. 14, 1971, to Rene L. Bonfils, adjusts all electrodes in an electrolytic cell using apparatus which measures the cell voltage and current in a series of circuits which regulate the anode-cathode gap by establishing a voltage proportional to U−RI, where U is the cell voltage, I the cell current and R the predetermined resistance of the cell.

A method of adjusting electrodes by measuring the currents to individual electrodes in cyclic succession and adjusting the spacing of those anodes whose measured currents differ from a selected range of current values is disclosed in U.S. Pat. No. 3,531,392, which issued Sept. 29, 1970, to Kurt Schmeiser. All electrodes are adjusted to the same range of current values and no measurement of voltage is made.

A method of detecting incipient short circuiting is disclosed in U.S. Pat. No. 3,361,654, which issued Jan. 2, 1968, to D. Deprez et al, by advancing an anode an unknown distance toward the cathode, measuring current as the anode moves and stopping movement of the anode when the current of the cell undergoes a rapid increase disproportionate to the speed of anode advancement, and then reversing the direction of anode movement a selected distance. This method adjusts the electrode with respect to the cell current.

West German Patent No. 1,804,259, published May 14, 1970, and East German Patent No. 78,577, issued Dec. 20, 1970, also describe techniques for adjusting the gap between anodes and cathodes.

While the above methods provide ways of adjusting the anode-cathode spacing in an electrolyte cell, it is well known that in a cell containing a plurality of electrodes, the optimum anode-cathode spacing for a particular electrode will depend on its location in the cell, and its age or length of service, among other factors. For example, in a horizontal mercury cell for electrolyzing alkali metal chlorides, the optimum anode-cathode spacing for an anode located near the brine entry end of the cell is different from the spacing for one located near the brine exit and, in addition, decomposition voltage varies throughout the cell as brine temperature and concentration change. Likewise, a new anode can maintain a closer anode-cathode spacing than one which has been in the cell for a longer period of time or can operate more efficiently at the same spacing. In addition, after an anode has been lowered it is necessary to know whether the anode-cathode spacing is too narrow, which may cause short circuiting or loss of efficiency.

There is a need at the present time for an improved method and apparatus for controlling the space between an adjustable anode and a cathode which utilizes current measurements, and/or voltage measurements or a combination thereof to effect adjustment of the electrode space of individual anode sets under the varying conditions occurring in the aforesaid electrolytic cells.

It is an object of this invention to provide an improved method and apparatus for adjusting anode-cathode spacing in an electrolytic cell which overcome disadvantages in previously known techniques for adjusting this spacing.

It is a further object of this invention to provide a method for detecting and avoiding incipient short circuits between anode and cathode in electrolytic cells employing liquid cathodes.

Still another object of the invention is to provide an improved method of inhibiting incipient short circuits in electrolytic mercury cells.

Briefly, the objects of this invention are accomplished in an electrolytic cell comprised of adjustable anodes, at least one conductor electrically connected to said anodes, a liquid cathode, at least one secondary conductor electrically connected to said liquid cathode, and an aqueous electrolyte between said liquid cathode and said anodes, wherein voltage is applied across said anodes and said liquid cathode to develop an electric current which passes sequentially through said conductor, said anodes, said electrolyte, said liquid cathode, and said secondary conductor, characterized by the improved process for detecting an incipient short circuit between said cathode and a specific said anode connected electrically to a specific said conductor which comprises:

(a) obtaining a first conductor current value proportional to current in said conductor, and storing said value in a table of old values, (b) obtaining the next conductor current value proportional to current in said conductor, and storing said value in a table of new values, (c) subtracting said first conductor current value from said next conductor current value for said conductor to obtain a first conductor current difference, $\Delta_a$, (d) when $\Delta_a$ is negative or zero, recording zero as the value for $\Delta_a$ in said table of old values for said conductor, (e) when the value of $\Delta_a$ is positive, adding this value to any value for said conductor previously recorded in said table of old values to obtain $\Delta_t$, (f) squaring the value of $\Delta_t$ to obtain $\Delta_s$, (g) adding the value, $\Delta_s$, to any sum previously recorded in said table of old values corresponding to the sum of previous increases for said conductor to obtain a new summation value, $\Delta_{st}$, (h) replacing the conductor current values in the old table with the new conductor current values, (i) repeating steps (b)–(h), N times over a period of t seconds for said conductor to obtain a new $\Delta_{st}$ for said conductor, (j) dividing said $\Delta_{st}$ by N to obtain a quotient, Q, for said conductor, and comparing Q with the conductor current value, and (k) raising said anodes connected to said conductor when Q exceeds a predetermined fraction of the conductor current value.

Figure 1:
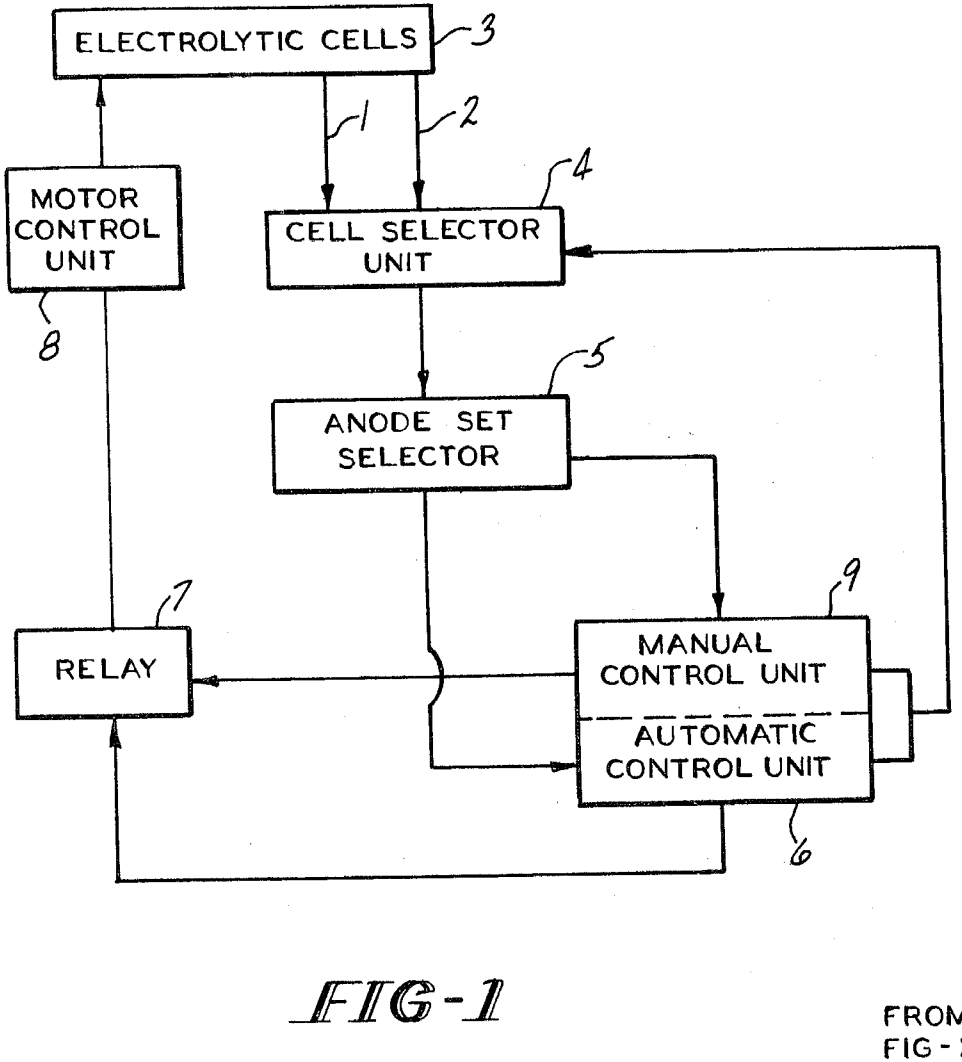
FIG. 1 is a block diagram showing generally the layout of the apparatus for carrying out this invention.

FIG. 1 illustrates typical apparatus of this invention in block diagram form where electric signals representing current measurements 1 and electric signals representing voltage measurements 2 from each conductor to each anode set (not shown) for each electrolytic cell 3 are selected by cell selector unit 4. Anode set selector unit 5 in response to a signal from manual control unit 9 selects electric signals for current measurements 1 and voltage measurements 2 from any conductor of any desired anode set in electrolytic cell 3 through cell selector unit 4. Automatic control unit 6 transmits signals to cell selector unit 4 to select current measurements 1 and voltage measurements 2 from cell selector unit 4 for desired anode sets and performs the required calculations and comparisons with predetermined limits. When these calculations and comparisons show that raising or lowering of the anode set is necessary, appropriate electric signals are conveyed to relay 7, then to motor control unit 8 which operates upon the anode adjustment mechanism (not shown) to raise or lower the anode set. Motor control unit 8, which can be used for increasing or decreasing the anode-cathode spacing in any anode set in electrolytic cell 3, can also be controlled by manual control unit 9 through anode set selector unit 5.

Figure 2:
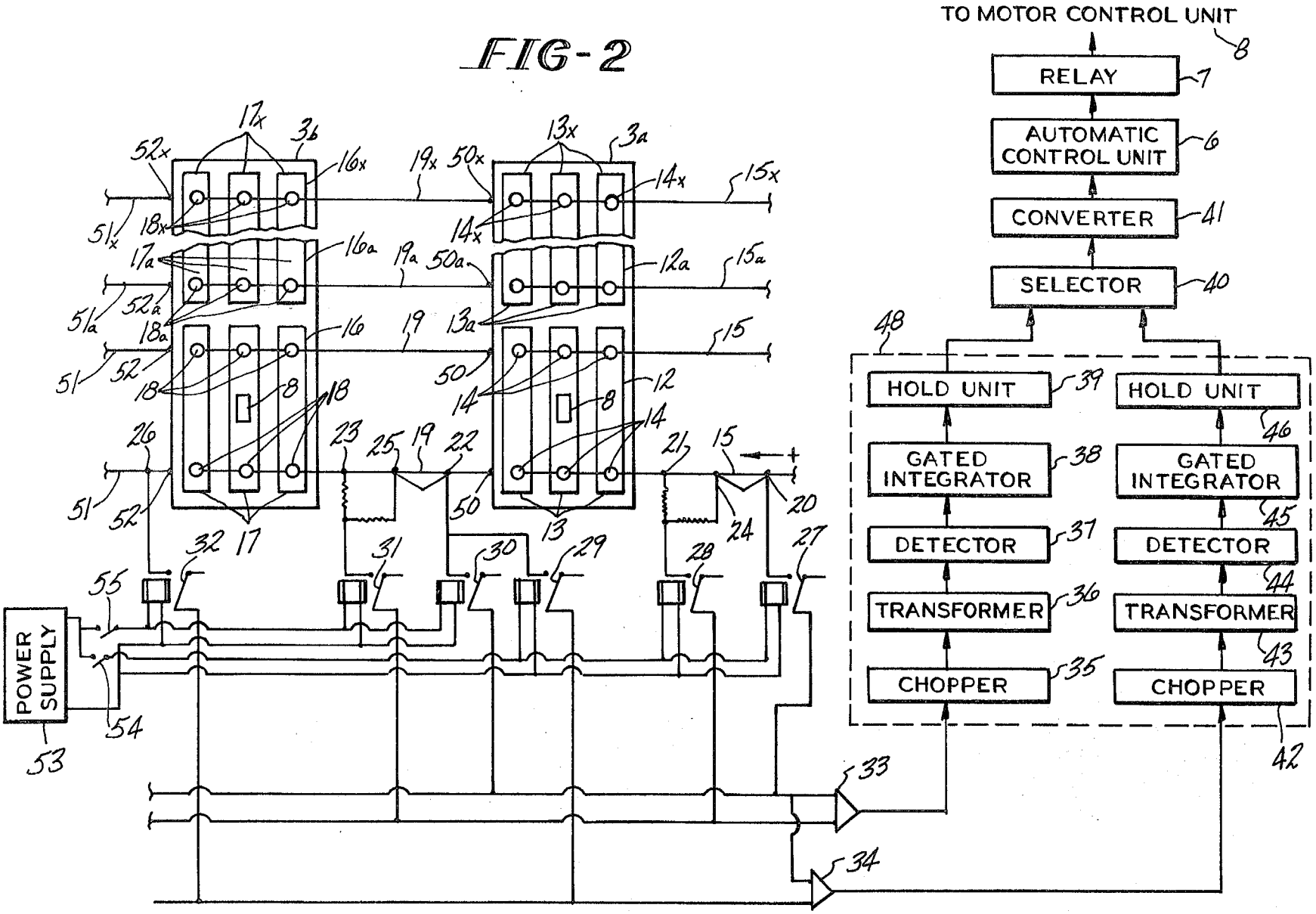
FIG. 2 is a block diagram showing one embodiment of the invention including a signal isolation and signal conditioning system utilizing a transformer.

FIG. 2 is a block diagram showing one embodiment of the signal selection and conditioning system for two adjacent electrolytic cells **3*a* and 3*b***, respectively, in series.

Electrolytic cell **3*a* has a plurality of anode sets 12, 12*a* and 12*x*. Anode set 12 is comprised of at least one anode 13, for example three parallel anodes 13. Each anode 13 is provided with at least one anode post 14, and with two anode posts 14 preferably, as shown, with the anode posts 14 arranged in two parallel rows. A conductor 15 is connected to each row of anode posts 14 in electrolytic cell 3*a*. Current from plant supply (not shown) is conveyed through two conductors 15 to each row of anode posts 14 in anode set 12. Anode sets 12*a* and 12*x* are each comprised of three anodes, 13*a* and 13*x*, respectively, having two rows of anode posts 14*a* and 14*x*, respectively, secured to conductors 15*a* and 15*x***, respectively.

Adjacent electrolytic cell **3*b* has a corresponding number of anode sets 16, 16*a*, and 16*x*. Anode set 16 is comprised of three parallel anodes 17 having two rows of anode posts 18 in each anode set 16. Anode sets 16*a* and 16*x* each have three parallel anodes 17*a* and 17*x* with two rows of anode posts 18*a* and 18*x***.

Current from anode posts 14 of electrolytic cell **3*a* passes to anodes 13, through the electrolyte (not shown), the mercury amalgam (not shown) to the bottom of electrolytic cell 3*a***.

Each conductor 19 connects to a terminal 50 at the bottom of electrolytic cell **3*a* at points adjacent to the nearest anode 13 and conveys current to the corresponding rows of anode posts 18 in electrolytic cell 3*b*. In a similar manner, current passes from anode post 14*a* and 14*x*, respectively, to anodes 13*a* and 13*x*, respectively, through the electrolyte and the mercury cathode to the bottom of electrolytic cell 3*a*. The cathode terminal is shown symbolically as cathode terminal 50 at the side of electrolytic cell 3*a*, but it is actually positioned on the bottom of the electrolytic cell 3*a***, as is well known in the art, as shown in FIG. 2 of U.S. Pat. No. 3,396,095.

Each conductor 19 conveys current from cathode terminal 50 connected to the bottom of electrolytic cell **3*a* below anode posts 14 to the corresponding row of anode posts 18 in electrolytic cell 3*b*. Conductors 19*a* and 19*x* convey current from other cathode terminals 50*a* and 50*x* below rows of anode posts 14*a* and 14*x*, respectively, to anode posts 18*a* and 18*x***, respectively.

The voltage drop between terminals 20 and 21 on conductor 15 is measured to obtain an electrical signal which is proportional to the current flow to anode set 12. Similarly, the voltage drop between terminals 22 and 23 on conductor 19 is measured to obtain an electric signal which is proportional to the current flow to anode set 16.

The distance between terminals 20 and 21 is the same as the distance between terminals 22 and 23. The current signals from these terminals are altered by thermistor circuits 24 and 25, respectively, where the current signals are temperature compensated. Although FIG. 2 shows thermistor circuit 24 touching conductor 15, it is not in electrical contact with the conductor. Instead, the thermistor circuits are embedded in the bus bar or conductor 15 with an appropriate heat conducting electrical shield. Current signals from thermistor 24 are transmitted across relay circuits 27 and 28 to amplifier 33 and current signals from thermistor 25 are transmitted across relay circuits 30 and 31 to amplifier 33.

The voltage drop across electrolytic cell 3*a* at conductor 15 of anode set 12 is measured between terminal 20 on conductor 15 and terminal 22 on conductor 19, which is the corresponding terminal for the corresponding anode set of the adjacent electrolytic cell 3*b*. Similarly, the voltage drop across electrolytic cell 3*b* at conductor 19 in anode set 18 is measured between terminal 22 on conductor 19 and terminal 26 on conductor 51, which is the corresponding terminal for the corresponding anode set of the next adjacent electrolytic cell. Thus, the "voltage drop across an anode set", such as anode set 12, is based upon the flow of current from a given point 20 on conductor 15 through anode posts 14 to anodes 13, through the electrolyte, mercury cathode and cathode terminal 50 to terminal 22 on conductor 19. A second voltage drop across anode set 12 is obtained in the same way between the other conductors 15 and 19 communicating with the other row of anode posts 14. These voltage drops for each conductor 15 of anode set 12 are averaged to determine the voltage drop across anode set 12.

Current signals are obtained for the other conductor 15 to anode set 12 as well as all of the other conductors 15*a*, 15*x*, 19, 19*a* and 19*x* in the same manner as described above and as shown in FIG. 2 for conductor 15.

Voltage signals based upon voltage drop across the anode set are obtained for the other row of anode posts 14 of anode set 12 as well as for each of the other rows of anode posts for anode sets 12*a*, 12*x*, 16*a* and 16*x* in the same manner as described above and as shown in FIG. 2.

Current is conveyed from the mercury cathode of electrolytic cell 3*b* through cathode terminals 52, 52*a* and 52*x* positioned beneath rows of anode posts 18, 18*a* and 18*x*, respectively, to conductors 51, 51*a* and 51*x*, respectively.

Thus, for an electrolytic cell containing ten anode sets, each anode set having two rows of anode posts connected to the anodes in the set, there are twenty conductors, each providing through relay circuits 27–32, (which are a first level multiplexing means), a current signal to one of twenty separate amplifiers 33 and a voltage signal to one of twenty separate amplifiers 34.

Relay circuits 27 and 28 are activated through power supply 53 when switch 54 is moved to a closed position. Relay circuits 30 and 31 are also activated through power supply 53 when switch 55 is moved to a closed position.

Temperature compensated current signals are amplified in amplifier 33 and conveyed to chopper 35 in signal isolation and conditioning system 48 where they are converted from direct current signals to alternating current signals. These signals are then transmitted at cell potential to transformer 36 having one terminal of the primary winding connected to cell potential and one terminal of the secondary winding connected to earth potential. The current signals are isolated in transformer 36 and leave at earth potential in order to be compatible with automatic control unit 6. The current signals are transmitted from transformer 36 to detector 37 where the isolated current signals are converted from alternating current signals to direct current signals, and the resulting direct current signals are transmitted to a gated integrator 38 where rejection of electrical noise, particularly that generated by the rectifier which supplies current to electrolytic cells 3*a* and 3*b* is effected. Noise conditioned current signals are transmitted to hold unit 39 (capacitor) and stored until selected by selector 40, the second level multiplexing means.

In a similar manner, the voltage signals are amplified in amplifier 34 and conveyed to a chopper 42, then at cell potential are conveyed to a transformer 43, where the voltage signals are isolated and leave at earth potential. These signals are converted from alternating to direct current in detector 44 and then to gated integrator 45 where rejection of electrical noise is also effected. The resulting voltage signals are transmitted to hold unit 46, (capacitor) where they are stored until selected by selector 40 in the same manner as current signals stored in hold unit 39. In response to a programmed electric signal from automatic control unit 6, (or if desired, an electric signal initiated manually from manual control unit 9 of FIG. 1), current signals and voltage signals from selector 40 for any conductor of any desired anode set such as conductor 15 of anode set 12 or conductor 19 of anode set 16 are selected and transmitted to convertor 41 where they are converted from analog form to binary form and then transmitted to automatic control unit 6 for processing. In automatic control unit 6, the selected signals are compared with predetermined values for the same conductor and anode set, and when necessary, the selected anode set is raised or lowered by an appropriate electric signal from automatic control unit 6 through relay 7 to motor drive 8, which operates to raise or lower the selected anode set.

Generally only one selector 40 is needed as a second level multiplexing means for the entire cell series, but additional selectors 40 may be employed, if desired.

Figure 3:
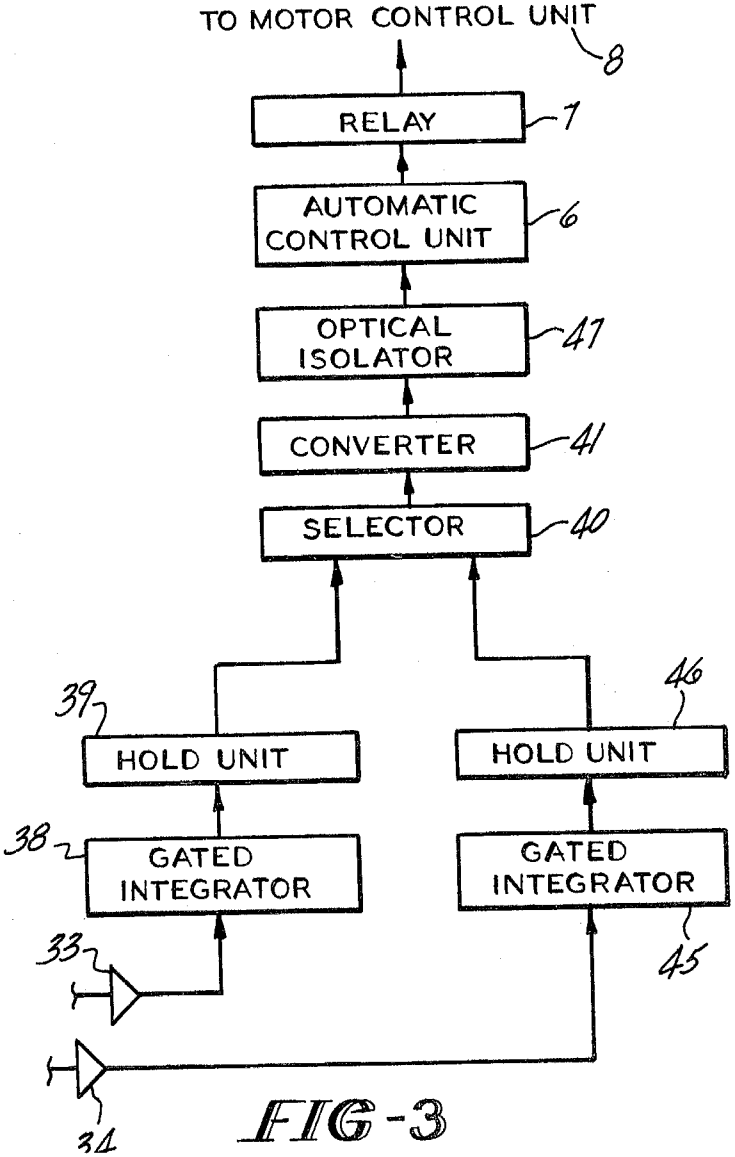
FIG. 3 is a block diagram showing another embodiment of the invention including a signal isolation and signal conditioning system utilizing an optical isolator.

FIG. 3 shows another embodiment of the invention utilizing an optical isolator. In FIG. 3, temperature compensated current signals from amplifier 33 in FIG. 2 are conveyed to gated integrator 38 where rejection of electrical noise, particularly that generated by the rectifier which supples current to electrolytic cells 3*a* and 3*b*, is effected. Noise conditioned current signals are transmitted to hold unit 39 and stored until selected by selector 40.

In a similar manner, voltage signals from amplifier 34 of FIG. 2 are conveyed in FIG. 3 to a gated integrator 45 where rejection of electrical noise is also effected. The resulting voltage signals are transmitted to hold unit 46, where they are stored until selected by selector 40 in the same manner as current signals stored in hold unit 39. In response to a programmed electric signal from automatic control unit 6, or, if desired, a manually initiated electrical signal, current signals and voltage signals from selector 40 for any desired anode set are selected, the signals are transmitted to convertor 41 where they are converted from analog form to binary form and then transmitted to optical isolator 47.

Signals enter optical isolator 47 at cell potential, are isolated and transmitted at earth potential to automatic control unit 6, where the selected signals are compared with predetermined values, and when necessary the selected anode set is raised or lowered in the same manner as described for FIG. 2.

Figure 4:
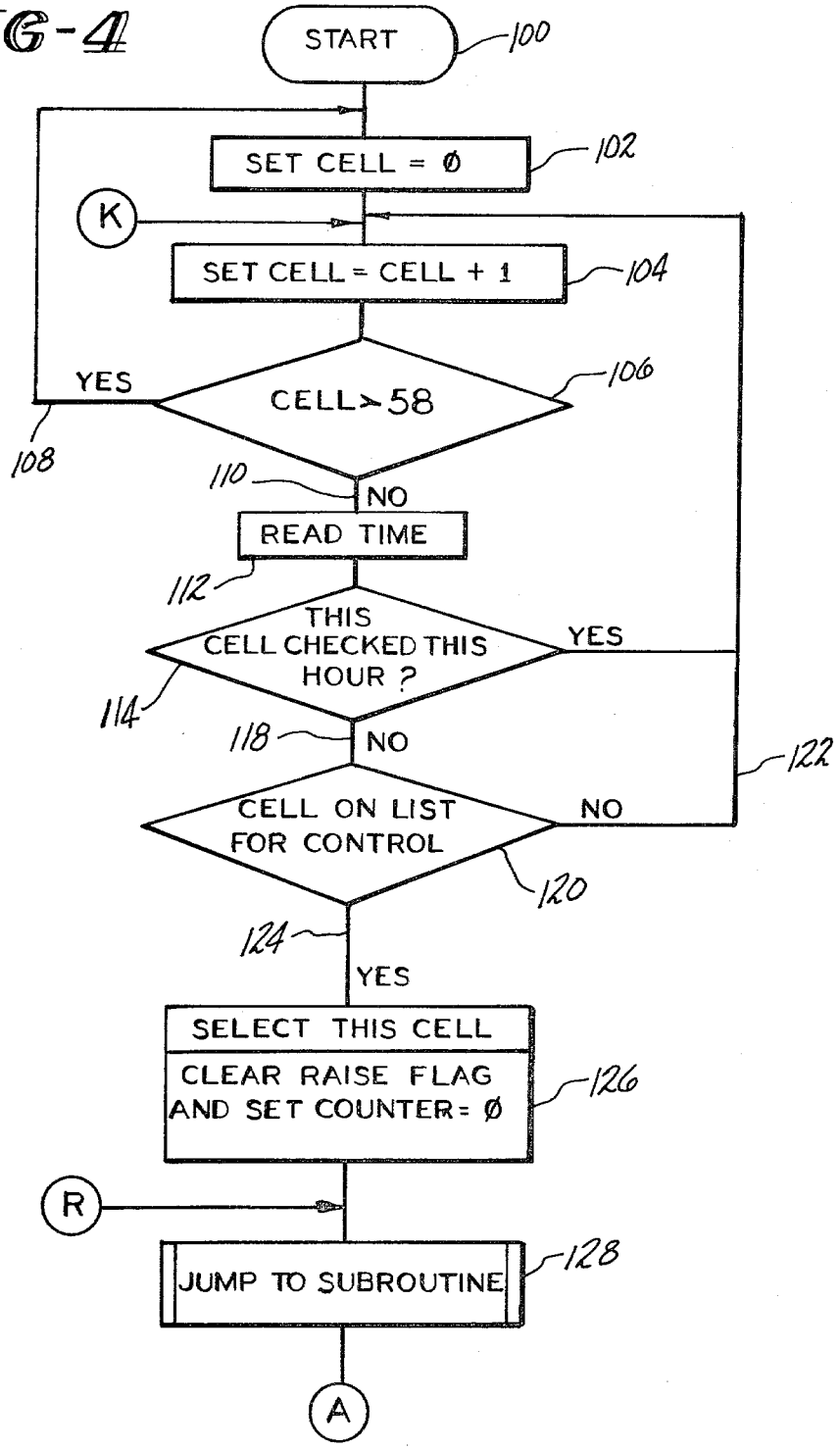
FIGS. 4–6 show a typical program flow sheet for detecting incipient short circuits in the apparatus of FIGS. 1–3.
Figure 5:
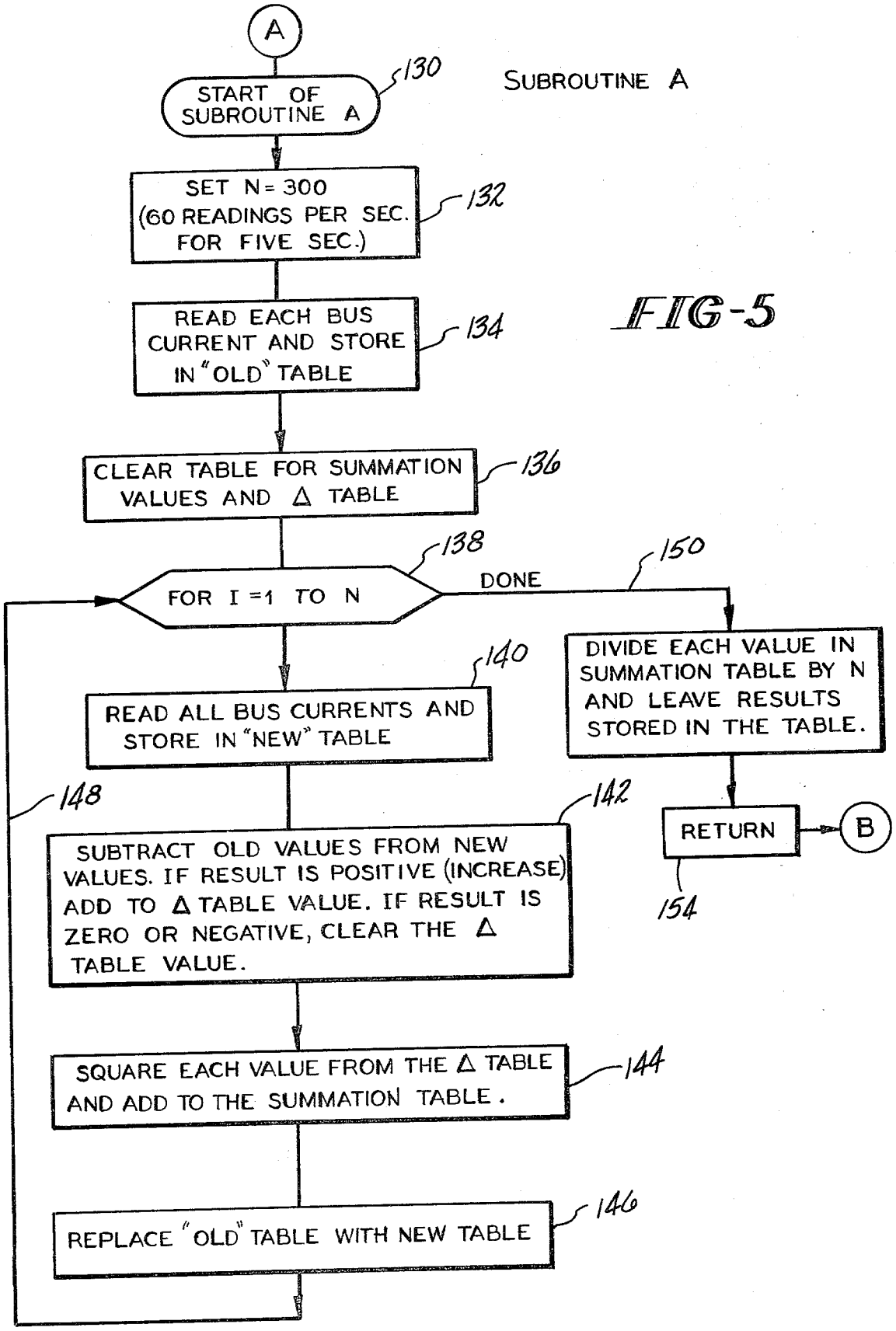
Figure 6:
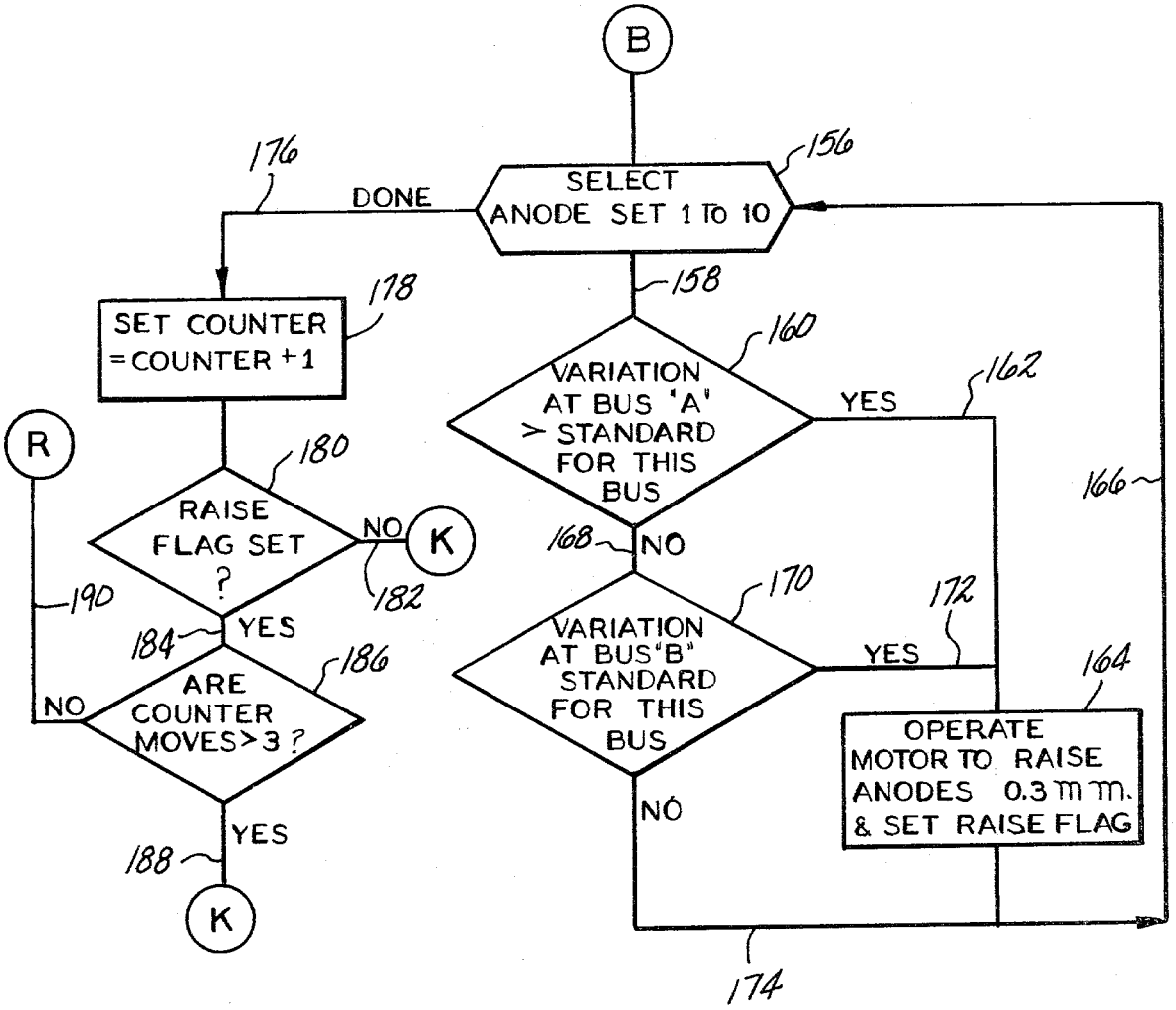

FIGS. 4–6 describe a typical program for detecting and avoiding incipient shorts in the operation of the process and apparatus described in FIGS. 1–3 for a cell system comprised of 58 electrolytic mercury cells 3 in series. Each cell 3 operates at a current of about 150,000 KA and a voltage of about 4 volts. Each cell 3 contains 10 anode sets 12, and each anode set 12 consists of five anodes 13. Each anode 13 is provided with two anode posts 14 which are connected by means of two conductors 19 or bus bars in parallel with the corresponding anode posts 18 of the adjacent anodes 17 of anode set 16. Each anode set 12 and 16 is provided with an electric motor driven, sprocket operated adjusting device 8 of the type described in U.S. Pat. No. 3,574,073, which issued Apr. 6, 1971, to Richard W. Ralston, Jr. The electric motor drive 8 for each anode set 12 and 16 and each bus bar 19 are connected electrically, as shown in FIGS. 1–3 to automatic control unit 6. Automatic control unit 6 is a digital computer provided with a program of the type shown in FIGS. 4–6 to adjust the gap between the anodes of each anode set 12 and 16 and the mercury cathode during electrolysis of salt brine in the cells.

Referring to FIG. 4, beginning with start 100 the program proceeds to processing step 102 where the "cell" variable is set equal to zero. In the next step 104, the program adds "1" to the "cell" number and then tests in decision step 106 the resulting number to determine if it is greater than the number of cells in the plant program, (58 cells). If the cell number determined in decision step 106 exceeds 58, the program returns by path 108 to start 100. If the cell number does not exceed 58 in decision step 106, the program follows path 110 to time clock 112 where the time is read, recorded, and then checked with the prior time of adjustment of anodes for the specific cell number. In decision step 114 a determination is made whether an adjustment has been effected within the past hour. If the selected cell has been adjusted within the past hour, the program follows path 116 to step 104 where the next cell is selected. If it is determined in decision step 114 that the selected cell has not been adjusted within the past hour, the program follows path 118 to decision step 120 to determine if the selected cell is on the list of cells to be controlled by the program. If the cell is not on the list to be controlled, the program follows path 122 to step 104 where the next cell is selected. If the cell is on the list of cells to be controlled, the program follows path 124 to step 126, where the cell is selected, the raise flags are cleared and the counter is set equal to 0. The program then moves to step 128 where it jumps to start 130 of subroutine A, as shown in FIG. 5. In the first step 132 of subroutine A, the number of times for reading each signal per second for each bus bar is set, for example, at 60 readings per second for a period of five seconds. The program then proceeds to step 134 where all current signals in each bus bar of the selected cell are read one time and stored as a set of previous readings in the old table. As shown in FIG. 2, these current signals are obtained by operating relays 27 and 28 for conductor 15 of cell 3*a* of FIG. 2, and the corresponding relays for the corresponding conductors 15*a*–15*x* entering the entire cell. Each of these current signals are conveyed to selector 40 as shown in FIG. 2.

In step 136, the new table is cleared for summation values. The program then proceeds to process step 138 where the next reading is selected in a set of N readings for a given bus, and the selection is conveyed to process step 140 where the current signals for each bus in the selected cell is read and stored in the new table. As indicated, N may equal 300 for a period of, t, five seconds, but any suitable N and t may be employed. For example, N may range from 10 to 80 times per second, and t may range from about 2 to about 10 seconds.

The program then proceeds to process step 142 where a reading of conductor current values for each bus is obtained and subtracted from the old corresponding reading for the bus previously obtained. The differences, $\Delta_a$, is calculated. Positive current differences are retained and added to previously obtained current differences already stored in the $\Delta$ table to form a total current difference, $\Delta_t$. However, if the current difference, $\Delta_a$, is zero or negative for a selected bus, then the $\Delta_t$ in the table is cleared for that bus.

The program then proceeds to process step 144 where each total current difference, $\Delta_t$, for a selected bus is squared to obtain the squared selected current difference, $\Delta_s$, which is added to previously existing values for that conductor in the summation table to obtain $\Delta_{st}$.

The program then proceeds to process step 146 where the values obtained for the new table are used to replace the values for the old table. The program then follows path 148 to return to process step 138. After $\Delta_s$ values and summation of squared current differences values, $\Delta_{st}$, are obtained for each bus in the cell, the program follows path 150 to process step 152 where the values in the summation table are divided by the number N to obtain a value Q for each conductor or bus, which is then stored in the new table. Since Q is a "squared" number, the value of Q may be placed directly in the new table as such and compared with the conductor current value, with or without appropriate adjustment, such as obtaining the square root of Q, or applying a suitable factor to the conductor current value, or adjustment of the predetermined maximum value for Q.

The program then proceeds to process step 156 which successively selects the anode set to be evaluated by steps 160 and 170. For a selected anode set having conductors A and B (or bus A or bus B) the program proceeds along path 158 to selection step 160 which selects the calculated value Q for bus A and compares it with standard pedetermined maximum deviation of Q for this bus bar.

Depending upon the position and the past history of the anode sets in the cell, a separate deviation of Q may be established for each conductor, but generally the deviation range is the same for each conductor. For example, if the value of Q exceeds the conductor current value by form about 0.25 to about 0.5 percent, the anode or anode set connected to that particular conductor is immediately raised to avoid a potential short circuit.

If the variation of Q for bus A, as determined in step 160, exceeds the maximum preselected limit for this selected bus bar, the program follows path 162 to process step 164 where a signal is sent to motor control unit 8 to raise the anodes a predetermined distance, for example, about 0.3 mm. The program then follows path 166 to return to selection step 156 for analysis of additional anode sets in the cell. If the analysis of current values in step 160 shows that the value of O for bus A is less than the preselected standard maximum, the program follows path 168 to process step 170 where the value of Q for companion bus bar B is compared with the preselected standard maximum, the program follows path 172 to step 164 where an appropriate signal is sent to motor control unit 8 for raising the anode set by about 0.3 mm.

If the current sinals of bus bar A and bus bar B are both below the preselected standard maximum, the program follows path 174 to selection step 156 where the procedure is repeated until all anode sets in the cell have been checked.

The program then follows path 176 to process step 178 where the set counter is set at the counter number plus one and then proceeds to decision step 180 to determine whether the raise flag is set. If there is no movement or no reason to recheck the cell, the program follows path 182 to the main program at point K of FIG. 4. If movement of an anode set has been made, as determined in decision step 180, the program follows path 184 to decision step 186 where a count of movements is made to determine if the number of movements exceeds three. If the number of movements exceeds three, the program follows path 188 to the point K of the main program of FIG. 4. If the number of movements is less than three, the program follows path 190 back to point R of FIG. 4 prior to jumping to subroutine A at step 128 and the procedure is repeated.

The method and apparatus of the present invention may be used on a variety of electrolytic cell types used for different electrolytes and electrolysis systems. The invention is particularly useful in the electrolysis of alkali metal chlorides to produce chlorine and alkali metal hydroxides. More particularly, the invention is especially suitable for use in combination with the anode adjusting mechanisms driven by an electric motor or the like operating on adjustable anodes positioned in horizontal electrolytic cells having a liquid metal cathode such as mercury, as disclosed, for example in U.S. Pat. Nos. 3,390,070 and 3,574,073, which are hereby incorporated by reference in their entirety.

As indicated in U.S. Pat. No. 3,574,073, issued Apr. 6, 1971, to Richard W. Ralston, Jr., horizontal mercury cells usually consist of a covered elongated trough sloping slightly towards one end. The cathode is a flowing layer of mercury which is introduced at the higher end of the cell and flows along the bottom of the cell toward the lower end. The anodes are generally composed of slotted rectangular blocks of graphite or metal distributors having an anodic surface comprised of titanium rods or mesh coated with a metal oxide secured to the bottom of the distributor. Anode sets of different materials of construction may be employed in the same cell, if desired. The anodes are suspended from at least one anode post such as a graphite rod or a protected copper tube or rod. Generally, each rectangular anode has two anode posts, but only one, or more than two, may be used, if desired. The anodes in each anode set are placed parallel to each other, the anode posts forming parallel rows across the cell. The bottoms of the anodes are spaced a short distance above the flowing mercury cathode. The electrolyte, which is usually salt brine, flows above the mercury cathode and also contacts the anode. Each anode post in one row of an anode set is secured to a first conductor, and the other row of anode posts is secured to a second conductor. Each conductor is adjustably secured at each end to a supporting post secured to the top of the cell. Each supporting post is provided with a drive means such as a sprocket which is driven through a belt or chain or directly by a motor such as an electric motor, hydraulic motor or other motor capable of responding to electric signals from automatic signal device 6.

Although the invention is particularly useful in the operation of horizontal mercury cells used in the electrolysis of brine, it is generally useful for any liquid cathode type electrolytic cell where adjustment of the anode-cathode space is necessary for efficient operation.

The number of electrolytic cells controlled by the method and apparatus of this invention is not critical. Although a single electrolytic cell can be controlled, commercial operations containing more than 100 cells can be successfully controlled.

Each electrolytic cell may contain a single anode, but is preferred to apply the method and apparatus of this invention to electrolytic cells containing a multiplicity of anodes. Thus the number of anodes per cell may range from 3 to about 200 anodes, preferably from about 5 to about 100 anodes.

It is preferred, particularly on a commercial scale to adjust anode sets when adjusting the space between the anodes and cathode of electrolytic cells. An anode set may contain a singel anode, but it is preferred to include from 2 to about 20 anodes, and preferably from about 3 to about 12 anodes per anode set. Voltage and current measurements are obtained for each conductor for each row of anode posts of each anode set in each cell.

When each anode set, such as anode set 12, is initially connected in an electrolytic cell 3*a*, which is operated by the method and apparatus of this invention, anode set 12 is lowered to a point where the bottoms of anodes 13 are about 3 millimeters above the mercury cathode. In addition, a set point for the standard voltage coefficient, S, for each conductor 15 is entered into the program of automatic control unit 6. This set point voltage coefficient and subsequent measurements of voltage coefficients, Vc, are calculated according to the formula:

$$Vc = \frac{V - D}{KA/M^2}$$

where V is the measured voltage across an anode set, D is the decomposition voltage for the electrolysis being conducted, and $KA/M^2$ is the current density in kiloamperes per square meter of cathode surface below each anode set. In the electrolysis of sodium chloride in a mercury cell for producing chlorine, the value for D is about 3.1.

Standard or set-point voltage efficient, S, may vary with a number of factors such as the material of construction of the anode (graphite or metal), the form and condition of the anodes (blocks of graphite which are slotted or drilled, metal mesh or rods coated with a noble metal or oxide) and the location of the anode set in the cell, among other factors. As indicated in "Intensification of Electrolysis in Chlorine Baths with a Mercury Cathode", *The Soviet Chemical Industry*, No. 11, November, 1970, pp. 69–70, the standard voltage coefficient (K or S) was found to vary as follows:

| K, standard voltage coefficient, V/ka | Condition |
|---|---|
| 0.55 | no device for regulating anode position |
| 0.3 | use of device for lowering anode |
| 0.2 | intensive perforation of the anodes |
| 0.14 | increased perforation of the anodes |
| 0.09 | use of titanium anodes with ruthenium dioxide coating |
| 0.022 | anodes specially placed in the amalgam |

When the anode set is comprised of metal anodes having a titanium distributor with an anodic surface formed of small parallel spaced-apart titanium rods coated with an oxide of a platinum metal secured to the bottom of the distributor, a standard voltage coefficient ranging from about 0.09 to about 0.13 is entered as the set-point into the program of automatic control unit 6. A deviation, k, which is the permissable range of deviation from S, is also entered into the program. Generally, k varies from about 0.1 to about 10, and preferably from about 2 to about 8 percent of S.

After positioning anode set 12 as described above and entering the values for S and k into the program, anode set 12 is lowered a small predetermined distance, from about 0.05 to about 0.5, and preferably from about 0.15 to about 0.35 mm. Then two electrical signals are generated and measured for each conductor 15 of anode set 12. One electric signal corresponds to the current flow in conductor 15 for anode set 12, and may be obtained by measuring the voltage drop between a plurality of terminals, preferably two (20 and 21) spaced a suitable distance apart along the conductor. The spacing between terminals may vary from about 3 to about 100 inches, but a space of about 30 inches is generally used. The space between terminals should be the same distance for all conductors. It is desirable that the terminals be located laterally in the middle of the conductor, in a straight segment of conductor of uniform dimensions. This straight segment of conductor serves as a shunt to provide a signal for the measurement of current through the conductor. Current measurements may also be obtained using other well known methods such as by the Hall effect or other magnetic detection devices.

The current signal is compensated for temperature changes in the conductor by thermal resistor 24 and other thermal resistors of the system which are coated with glass or other insulating material and then embedded or otherwise attached to the section of conductor or bus bar being used as the source of the current signal.

The other electric signal is the voltage drop which is measured between corresponding terminals across the anode set. When a multiplicity of cells are controlled by the method and apparatus of this invention, the terminals are on the conductors for the corresponding anode sets of two adjacent cells, such as terminal 20 on conductor 15 and terminal 22 on conductor 19

The current signals and the voltage signals for each conductor 15 to anode set 12 are transmitted to automatic control unit 6 as described above in the discussion of FIG. 2. It is preferred to obtain a series of N current measurements and a series of N voltage measurements for each conductor 15 for a predetermined period. For example, automatic control unit 6 is programmed to obtain current measurements and voltage measurements at the rate of from about 5 to about 120, and preferably from about 10 to 60 measurements per second. These measurements are obtained for a period of time ranging from about 1 to about 20, and preferably from about 2 to about 10 seconds. Under normal operation of the cell system, the maximum difference in the current measurements in the series at this position i.e., a gap of at least about 3 mm between the anode and cathode, is determined and utilized as described below in the second current analysis. The average current measurement and average voltage measurement are obtained in the computer for each series of measurements for each conductor 15. The average total current measurement for anode set 12 is obtained from the sum of the average currents to each conductor. The average voltage measurement is obtained for each anode set 12 by averaging the average voltage measurements for each conductor 15. These average values are then used by automatic control unit 6 to calculate the voltage coefficient for anode set 12 in accordance with the above formula for Vc.

In making the calculation for Vc for each anode set, the area of cathode surface below each anode set may be obtained by utilizing the individual conductor voltages and measuring the area of each anode set. If desired, the current density, $KA/M^2$ may be calculated by assuming that the current in one conductor 15 passes through half of the anode set area and current in the other conductor passes through the other half of the anode set. A formula utilized for Vc in an anode set having conductor 1 and conductor 2 is as follows:

$$Vc = \frac{\left(\frac{V_1 + V_2}{2}\right) - D}{\frac{KA_1 + KA_2}{M^2}}$$

where $V_1$ is the average voltage drop in volts across conductor 1.

$V_2$ is the average voltage drop in volts across conductor 2.

$KA_1$ is the average current in kiloamperes through conductor 1 through the cathode to the respective cathode compartment.

$KA_2$ is the average current in kiloamperes through conductor 2 through the cathode to the respective cathode compartment.

$M^2$ is the area of the cathode under the anode set, in square meters.

When the anode set 12 is initially installed it is generally positioned with a large gap, (about 3 mm or more) between the bottom of the anodes and the cathode. As a result, the first measured voltage coefficient Vc usually exceeds S by more than deviation k. After this comparison is completed, an electrical signal is transmitted from automatic control unit 6 to motor drive unit 8 to lower anode set 12 a small distance within the ranges described above.

A new voltage coefficient, Vc, is calculated for the new position of the anode set by the same procedure and the resulting voltage coefficient is compared with S. If the new voltage coefficient, Vc, exceeds S by more than deviation, k, the adjustment procedure is repeated until an anode set position is obtained where voltage coefficient Vc does not vary from S by more than the value of deviation k. After anode set 12 is in a position where the voltage coefficient falls within the deviation k of value S, the current measurements of conductor 15 for anode set 12 are also analyzed to determine whether the anode is too close to the cathode.

Following each decrease in the anode-cathode spacing, a series of N current measurements for each conductor 15 to anode set 12 are taken for a predetermined period within the above defined ranges, as described in FIGS. 4–6. Each current measurement is compared with the preceding current measurement for each conductor to determine the amount of current increase, and where the total selected current difference, $\Delta_t$, for a selected conductor exceeds $\Delta_a$, the total adjacent current difference, by more than about 1.0 percent and preferably by more than about 0.5 percent of $\Delta_t$, the anode-cathode spacing is immediately increased a predetermined distance.

Other adjustments of the anodes may be made based upon current analysis. For example, in a second analysis, if the increase in current between the current measurements made immediately before and immediately after the decrease in anode-cathode spacing is greater than a predetermined limit, the anode-cathode spacing is immediately increased. For example, if the anode set is lowered a distance within the above-defined ranges, for example about 0.3 mm, and an increase in current on either conductor 15 in excess of a predetermined limit occurs, for example, an increase of more than about 5 percent above the previous current measurement, automatic control unit 6 is programmed to transmit an electric signal to motor drive means 8 to cause the anode-cathode spacing to be immediately increased a distance within the above-defined ranges. If the decrease in anode-cathode spacing is smaller than 0.3 mm, a proportionately smaller increase in current differences is used as a limit to effect raising of the anodes.

In a third current analysis, if anode set 12 has not been raised in the first current analysis, a series of N current measurements are taken for each conductor 15 for a predetermined period in the ranges described above to determine the magnitude of current fluctuations. The third current analysis is made based upon the average magnitude of the current fluctuations or differences as determined by any convenient method prior to comparing with a predetermined average different limit. This average difference limit is determined, for example, by doubling the average different in the current measurements made in the series N for each conductor 15 when the anode set was initially installed at a large gap between the anode and cathode of at least about 3 mm. The average difference in current in the series of measurements obtained at the initial position generally ranges from about 0.2 to about 0.4 percent of the current to each conductor the anode set in that series and thus the predetermined limit for average current difference in a series N ranges from about 0.4 to about 1.6 percent.

The term "average difference" when used in the description and claims to define the magnitude of the current fluctuations is intended to include any known method of averaging differences. For example, in a preferred embodiment a calculation is made $\Sigma\Delta^2/N$, where $\Delta$ is the difference in current between each successive reading in the series and N is the total number of current measurements taken. If this average difference is greater than the predetermined average difference limit, the anode-cathode spacing is immediately increased a predetermined distance. As an alternate, the average difference may be obtained by the calculation $\sqrt{\Sigma\Delta^2/N}$ or any other similar statistical technique.

A fourth current analysis determined from the series N of current measurements is whether the current continues to increase for each measurement during series N during a predetermined time period described above. If the current continues to increase for each measurement, the anode-cathode spacing is immediately increased, for example, to the previous position. The number of measurements and the predetermined time period used in this analysis are within the ranges described above, but are more preferably about 180 measurements in four seconds.

The fifth analysis of the current measurements determines whether an increase in current for any two measurements during series N, is greater than a predetermined limit, for example, an increase of about 6–8 percent. If so, the anode-cathode spacing is immediately increased by an appropriate electric signal from automatic control unit 6 to motor drive unit 8.

A sixth current analysis compares each current measurement in the series with the previous current measurement, and if the difference between two successive current measurements exceeds a predetermined limit, the distance between the anode and cathode is increased by transmitting an appropriate electrical signal from automatic control unit 6 to motor drive unit 8. When one current measurement is exceeded by the next successive current measurement in an amount from about 0.5 to about 3 percent, and preferably from about 1 to about 1.5 percent of the prior current measurement, the distance between the anode and cathode is increased as described above.

In a seventh current analysis, particularly in a simultaneous scan of all conductors, if any current measurement of a conductcr exceeds the average bus current or average conductor current for the entire electrolytic cell by a difference ranging from about 10 to about 50 percent, and preferably from about 20 to about 40 percent of the average cell current for the entire electrolytic cell, then the anode set to which this conductor supplies current is raised a predetermined distance.

In a preferred embodiment of the invention, in a method of conducting electrolysis in an electrolytic cell curcuit having a plurality of electrolytic cells, each of said cells having a flowing mercury amalgam cathode and a plurality of anode rows in a plurality of vertically movable anode banks, and a current flow from the anodes in said anode banks to the cathode, and having a common control element the improvement comprising:

(a) discretely measuring each of the individual current flows through the anode rows of a single cell at intervals sufficient to detect and respond to incipient changes therein, (b) electrically generating individual first electrical signals proportional to the individual current flows in each of the individual anode rows;

(c) simultaneously transmitting all of the said first electrical signals from a single cell to and through a first level of switches, or first level multiplexing means, to a second level of switches, or second level multiplexing means, (d) individually transmitting each of said first electrical signals from said second level of switches to the common control element;

(e) electrically generating a second electrical signal proportional to the average of the individual current flows through said anode rows; and (f) electrically generating individual anode row error signals proportional to the difference between said individual first electrical signals and said second electrical signal, and raising an anode set when the sum $\Delta_m$, obtained by doubling the difference in current signals, $\Delta$, for a selected conductor, exceeds the sum $\Delta_a$ of adjacent conductor current differences by more than about 1.0 percent, and preferably more than about 0.5 percent.

Although it is possible to compare conductor current with average conductor current based upon the total cell current, it is preferred to compare conductor current with a prior current reading for the same conductor. When two or more conductors feed a single anode set, there may be a small amount of current crossing from one end of an anode in the set to the other end of the anode in the same set due to changes in anode characteristics. However, the bulk of the current, generally at least about 90 percent of the current, travels directly to the electrolyte for decomposition, through the liquid cathode to the cell bottom. At the cell bottom, the current is redistributed to the conductors carrying current to the next cell. Each of these conductors will generally have a different current from the corresponding conductor on the preceeding cell, even though the total current to each cell is equal. Measuring the change of current in the conductor based upon prior current measurements for the same conductor in accordance with this invention gives a more realistic basis for adjusting the anode than previously known techniques.

Under unusual circumstances, the current measurement of one conductor may indicate a need to lower the anode set while the measurement for another conductor to the same anode set may indicate a need to raise the anode set. In this situation, the anode set is raised. As indicated below, when the frequency of change of anode-cathode spacing exceeds a predetermined limit, the anode set is raised and removed from automatic control.

If any of the current analyses require raising of the anode set a predetermined distance, a new series of current and voltage measurements are obtained and a new voltage coefficient, Vc, is calculated. If the calculated voltage coefficient is below S by more than deviation, k, an electrical signal is transmitted from automatic control unit 6 to motor drive unit 8 to raise anode set 12 a small distance within the ranges described above. If the calculated voltage coefficient is above S by more than deviation k, the anode set is lowered a predetermined distance. If the new voltage coefficient is within the limits k, then the current analyses are repeated.

After a position is found for anode set 12 where the voltage coefficient is within the above-defined predetermined range and none of the above-defined current analysis requires raising anode set 12, it may be retained in this position until subsequent automatic scanning, which is defined more fully below, shows the need for further movement of the anode.

All anode sets in a selected cell may be simultaneously adjusted using the above method. The method of the second current analysis can also be employed to locate in a series of adjacent cells, the cell having the highest amount of current fluctuation.

In a further embodiment of the method of the present invention, all anode sets for all cells in operation are serially scanned periodically by the automatic control unit 6 and the current and voltage readings for each anode set compared with their predetermined value ranges. Where the current reading exceeds the above defined predetermined limits, the anode-cathode spacing is increased. This periodic scan detects current overloads to any anode set on a continuing basis. The automatic control unit requires about three seconds to scan the current and voltage measurements for a group of 58 cells containing about 580 anode sets. Any suitable interval between scans may be selected, for example, intervals of about one minute. If during a scan, the anode-cathode spacing for an anode set is increased, the scan is repeated for all anode sets for all operative cells.

A further embodiment of the method of the present invention comprises counting the frequency of change in the anode-cathode spacing for a particular anode set during a predetermined time period and where this frequency exceeds a predetermined number, raising the anode set to remove it from automatic control. For example, if the anode-cathode spacing for any anode set in the system is adjusted from about 20 to about 80, and preferably from about 50 to about 70 times over a 24 hour period, the anode set is raised and removed from automatic control. When this predetermined number of adjustments is exceeded, an appropriate signal such as sounding of an alarm, activating a light on a control panel or causing a message to be printed out on a reader-printer unit associated with a computer is effected, in order that the operator will examine the set to determine what the problem is and correct it.

If the current analyses indicates that the distance between the anode and cathode must be increased at several successive positions, the anode set is raised to the original starting position and a new standard voltage coefficient, S, is placed in the program of the automatic control unit 6. The new standard voltage coefficient, S, is increased a predetermined amount above the initial standard voltage coefficient S. Generally the increase is from about 5 to about 20, and preferably from about 10 to about 15 percent of the initial standard voltage coefficient. The above defined procedure for positioning the anode set based upon voltage coefficient is then repeated until a position is found where the voltage coefficient is within the above defined predetermined range.

Automatic control unit 6, when scanning shows voltage coefficient and current measurements to be outside predetermined limits, may also provide appropriate electric signals to motor drive unit 8, to lower anode set 12 a predetermined distance, r, obtain another set of measurements of current and voltage coefficient and continue lowering anode set incrementally a predetermined distance until the voltage coefficient or current analyses indicates that the anode set should be raised a predetermined distance, r. Automatic control unit 6 then provides signals to lower anode set 12 a fraction of r, for example $\frac{1}{2}$r, and a new set of measurements are obtained. If measurements do not require moving anode set 12 from this position, it is retained here until subsequent scanning shows the need for further adjustment.

A typical program for adjusting anodes under normal operating conditions is disclosed in the parent application, U.S. Ser. No. 919,530, filed June 27, 1978. The substance of that application, particularly FIGS. 4–9 and accompanying text, is hereby incorporated by reference in its entirety.

The following examples are presented to define the invention more completely without any intention of being limited thereby. All parts and percentages are by weight, unless otherwise specified.

EXAMPLE 1

A group of horizontal mercury cathode cells for the electrolysis of sodium chlordie is employed in this Example, each cell containing 20 bus bars, 10 anode sets, and each anode set containing 5 anodes. The anodes are constructed of titanium metal and partially coated with a noble metal compound. Each anode set is supplied with current by two conductors. The anode adjustment system of FIG. 2 is installed on the cells. Upon selection of one cell for possible adjustment of the anode-cathode spacing, a series of 240 readings is taken simultaneously for all anode sets in the cell over a period of about 5 seconds. The current measurement is obtained by measuring the voltage drop between two terminals spaced 30 inches apart on each conductor and the voltage measurement is obtained between two corresponding terminals on each conductor supplying current to the corresponding anode set for the next adjacent cell. Thus, a group of 240 current measurements and 240 voltage measurements is obtained for each of the two conductors (bus bar) supplying an anode set and for all 10 sets in the cell. Each group of measurements is signal conditioned and converted from analog to digital form and supplied to automatic control unit 6, a digital computer, where the average total current and voltage measurements are calculated.

The voltage coefficient is calculated from the average total current and voltage readings obtained and then compared with a predetermined standard individually selected for each of the anode sets.

Measurements of current for a selected first bus bar current conductor is given in Table I.

The incipient short circuits values, or quotient, Q, is determined by:

(a) obtaining a first conductor current value proportional to current in said conductor, and storing said value in a table of old values, (b) obtaining the next conductor current value proportional to current in said conductor, and storing said value in a table of new values, (c) subtracting said first conductor current value from said next conductor current value for said conductor to obtain a first conductor current difference, $\Delta_a$, (d) when $\Delta_a$ is negative or zero, recording zero as the value for $\Delta_a$ in said table of old values for said conductor, (e) when the value of $\Delta_a$ is positive, adding this value to any value for said conductor previously recorded in said table of old values to obtain $\Delta_t$, (f) squaring the value of $\Delta_t$ to obtain $\Delta_s$, (g) adding the value, $\Delta_s$, to any sum previously recorded in said table of old values corresponding to the sum of previous increases for said conductor to obtain a new summation value, $\Delta_{st}$, (h) replacing the conductor current values in the old table with the new conductor current values, (i) repeating steps (b)-(h), N times over a period of t seconds for said conductor to obtain a new $\Delta_{st}$ for said conductor, (j) dividing said $\Delta_{st}$ by N to obtain a quotient, Q, for said conductor, and comparing Q with the conductor current value, and (k) raising said anodes connected to said conductor when Q exceeds a predetermined fraction of the conductor current value.

From the results of Table I, it can be seen that the quotient Q in selected first bus bar conductor is below the limit of 0.5 percent of the conductor current value, 2000 and therefore no adjustment of the anode-cathode spacing was required. However, if the quotient Q for any conductor is 0.5 percent or greater, in this case, the anode set connected to such conductor is immediately raised about 0.3 mm and the current analysis is repeated.

TABLE I

Process for Detecting Incipient Short Circuit

| Anode Set No. 1 | | Bus Bar Conductor No. 1 | | N = 20 Readings |
|---|---|---|---|---|
| Reading No. | Conductor Current Reading | Conductor Current Difference $\Delta_a$ | Total Conductor Current Difference $\Delta_t$ | Squared Total Conductor Current Difference $\Delta_{st}$ |
| 1 | 2000 | — | — | — |
| 2 | 2001 | 1 | 1 | 1 |
| 3 | 2003 | 2 | 3 | 9 |
| 4 | 2001 | −1 | 0 | 0 |
| 5 | 2003 | 2 | 2 | 4 |
| 6 | 2005 | 2 | 4 | 16 |
| 7 | 2003 | −2 | 0 | 0 |
| 8 | 2002 | −1 | 0 | 0 |
| 9 | 2001 | −1 | 0 | 0 |
| 10 | 2003 | 2 | 2 | 4 |
| 11 | 2004 | 1 | 3 | 9 |
| 12 | 2005 | 1 | 4 | 16 |
| 13 | 2003 | −2 | 0 | 0 |
| 14 | 2005 | 2 | 2 | 4 |
| 15 | 2002 | −3 | 0 | 0 |
| 16 | 2003 | 1 | 1 | 1 |
| 17 | 2004 | 1 | 2 | 4 |
| 18 | 2001 | −3 | 0 | 0 |
| 19 | 2002 | 1 | 1 | 1 |
| 20 | 2001 | −1 | 0 | 0 |
| Total Squared Current Difference, $\Delta_{st}$ = | | | | 69 |

The quotient, Q, is defined as the total squared current difference, $\Delta_{st}$, divided by N, the number of readings. In this example, Q=69/20=3.45. Since Q is less than about 0.5 percent of the conductor current value of 2000, no adjustment of the anode is necessary. The same analysis is performed simultaneously on each of the other bus bar conductors of the cells. After about every 5 seconds thereafter, the entire analysis is continually repeated on all bus bar conductors to check for incipient short circuits.

What is claimed is:

1. In an electrolytic cell comprised of adjustable anodes, at least one conductor electrically connected to said anodes, a liquid cathode, at least one secondary conductor electrically connected to said liquid cathode, and an aqueous electrolyte between said liquid cathode and said anodes, wherein voltage is applied across said anodes and said liquid cathode to develop an electric current which passes sequentially through said conductor, said anodes, said electrolyte, said liquid cathode, and said secondary conductor, characterized by the improved process for detecting an incipient short circuit between said cathode and a specific said anode connected electrically to a specific said conductor which comprises:

(a) obtaining a first conductor current value proportional to current in said conductor, and storing said value in a table of old values, (b) obtaining the next conductor current value proportional to current in said conductor, and storing said value in a table of new values, (c) subtracting said first conductor current value from said next conductor current value for said conductor to obtain a first conductor current difference, $\Delta_a$, (d) when $\Delta_a$ is negative or zero, recording zero as the value for $\Delta_a$ in said table of old values for said conductor, (e) when the value of $\Delta_a$ is positive, adding this value to any value for said conductor previously recorded in said table of old values to obtain $\Delta_t$, (f) squaring the value of $\Delta_t$ to obtain $\Delta_s$, (g) adding the value, $\Delta_s$, to any sum previously recorded in said table of old values corresponding to the sum of previous increases for said conductor to obtain a new summation value, $\Delta_{st}$, (h) replacing the conductor current values in the old table with the new conductor current values, (i) repeating steps (b)–(h), N times over a period of t seconds for said conductor to obtain a new $\Delta_{st}$ for said conductor, (j) dividing said $\Delta_{st}$ by N to obtain a quotient, Q, for said conductor, and comparing Q with the conductor current value, and (k) raising said anodes connected to said conductor when Q exceeds a predetermined fraction of the conductor current value.

2. The process of claim 1 wherein said liquid cathode is mercury and said aqueous electrolyte is an aqueous brine.

3. The process of claim 2 wherein each of said conductors is electrically connected to a group of said anodes in parallel to form an anode set.

4. The process of claim 3 wherein each anode set is electrically connected to at least two of said conductors.

5. The process of claim 4 wherein the number of said conductors per said electrolytic cell ranges from about 2 to about 48 per cell.

6. The process of claim 1 wherein said current signals are obtained by a computer provided with a program which calls for obtaining said current signals and calculating said $\Delta_{st}$ for each electrical conductor at the rate of from about 10 to about 80 times per second for a period of about 2 to about 10 seconds.

7. The process of claim 6 wherein said period of obtaining current signals and calculating $\Delta_{st}$ is repeated in a sequence separated in time by a period ranging from about 10 to about 120 minutes.

* * * * *

UNITED STATES PATENT AND TRADEMARK OFFICE

CERTIFICATE OF CORRECTION

PATENT NO. : 4,251,336

DATED : February 17, 1981

INVENTOR(S) : Richard W. Ralston, Jr.

It is certified that error appears in the above-identified patent and that said Letters Patent are hereby corrected as shown below:

In Column 2, line 27, delete "78,577" and insert --78,557--.

In Column 13, line 46, delete "different" and insert --difference--.

In Column 13, line 48, delete "different" and insert --difference--.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*